US006966464B2

(12) United States Patent
Betkowski et al.

(10) Patent No.: US 6,966,464 B2
(45) Date of Patent: Nov. 22, 2005

(54) SEAT WITH BUILT-IN BEVERAGE DISPENSER

(76) Inventors: Brian R. Betkowski, 1124 Dekalb Ave., #21, Atlanta, GA (US) 30307; Robert Betkowski, 255 Westchester Dr., Griffin, GA (US) 30223

( * ) Notice: Subject to any disclaimer, the term of this patent is extended or adjusted under 35 U.S.C. 154(b) by 0 days.

(21) Appl. No.: 10/965,343

(22) Filed: Oct. 14, 2004

(65) Prior Publication Data

US 2005/0082316 A1 Apr. 21, 2005

Related U.S. Application Data

(60) Provisional application No. 60/511,451, filed on Oct. 15, 2003.

(51) Int. Cl.[7] ..... B67D 1/07
(52) U.S. Cl. ..... 222/192
(58) Field of Search ..... 222/192

(56) References Cited

U.S. PATENT DOCUMENTS

| | | | | |
|---|---|---|---|---|
| 2,865,433 A | | 12/1958 | Warner | |
| 3,120,404 A | | 2/1964 | Bramming | |
| 3,560,047 A | | 2/1971 | Davis | |
| 3,763,972 A | | 10/1973 | Karzmar | |
| 3,814,293 A | * | 6/1974 | Daves | 222/173 |
| 4,062,584 A | | 12/1977 | Pinkham et al. | |
| 4,420,097 A | | 12/1983 | Motsenbocker | |
| 4,533,050 A | * | 8/1985 | Bake, Jr. | 206/545 |
| D293,393 S | | 12/1987 | Bothun et al. | |
| 4,871,069 A | * | 10/1989 | Guimont | 222/192 |
| 5,222,782 A | | 6/1993 | Shrader | |
| 6,244,481 B1 | | 6/2001 | Brougher | |

* cited by examiner

*Primary Examiner*—Philippe Derakshani
(74) *Attorney, Agent, or Firm*—Gardner Groff, P.C.

(57) ABSTRACT

A seat portion removably receives and stores a container for a beverage or other liquid, and a dispensing assembly is coupled to the container for dispensing the beverage. Preferably, the seat portion includes a shell that covers a cushion, and the cushion or a frame under the cushion has a cavity for receiving the container. The container and dispensing assembly can be inserted into the shell for conveniently and safely storing the beverage, the dispensing assembly can be accessed to dispense the beverage, and the container can be removed from the shell for cleaning and refilling.

22 Claims, 8 Drawing Sheets

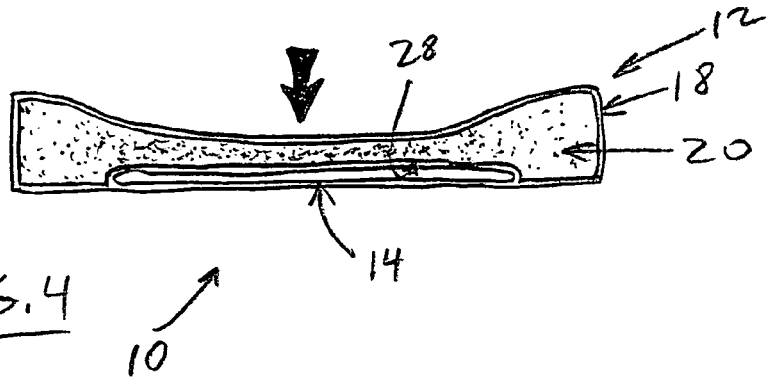
FIG. 4
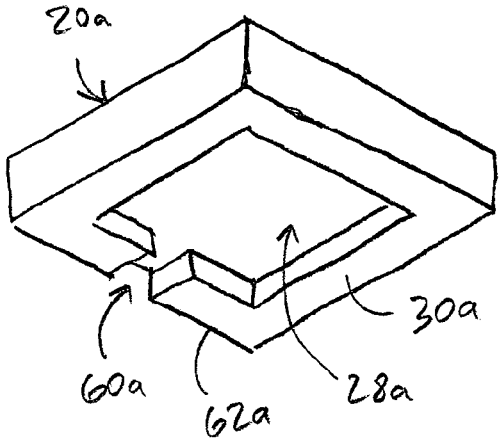
FIG. 5
FIG. 7
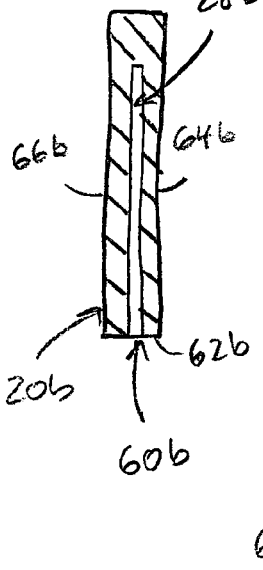
FIG. 6
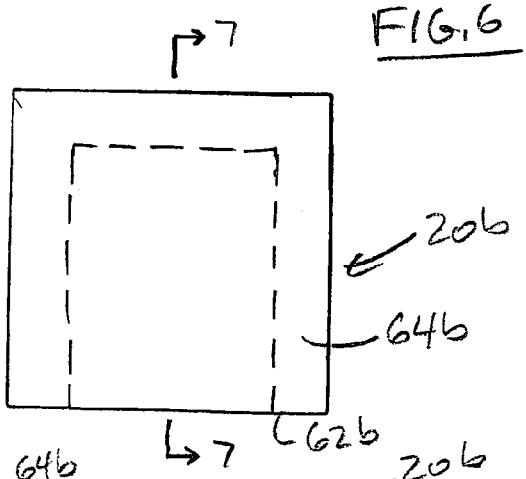
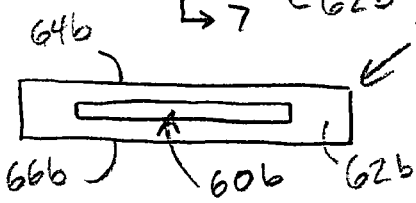
FIG. 8

SEAT WITH BUILT-IN BEVERAGE DISPENSER

CROSS-REFERENCE TO RELATED APPLICATION

This application claims the priority benefit of U.S. Provisional Patent Application Ser. No. 60/511,451 filed Oct. 15, 2003, the entire scope and content of which is hereby incorporated herein by reference.

TECHNICAL FIELD

The present invention relates generally to dispensers for liquids and, in particular, to portable devices with integral liquid dispensers.

BACKGROUND OF THE INVENTION

When attending sports games, concerts, and other events in stadiums, arenas, etc., attendees often carry accessory items such as cushioned seats, blankets, rain gear (e.g., umbrellas and parkas), binoculars, and food and drink. Bringing along these items can add to the enjoyment of the event by making the users more comfortable and enhancing their overall viewing pleasure of the event. But these events are often held at large venues with large parking areas, requiring the users to tote these items quite a long distance from the parking lot to their seats. So carrying all, or even a few, of these items into the event can be extremely inconvenient. This is particularly problematic for liquid refreshments, which tend to be heavy and cumbersome (at least in quantity). In addition, liquid refreshments are often purchased in glass containers, which are not allowed at many event venues for safety reasons.

Accordingly, there is a need for a way to increase the convenience and safety of carrying beverages and/or other accessory items into events. It is to the provision of such a solution that the present invention is primarily directed.

SUMMARY OF THE INVENTION

The present invention includes a combination sitting and liquid-dispensing device that has a seat portion for sitting upon, a container for a liquid such as a beverage, and a dispensing assembly for dispensing the beverage from the container. The dispensing assembly is coupled to the container, and the container and the dispensing assembly are disposed and fully contained within the seat portion.

In a first example embodiment of the present invention, the seat portion includes a shell having a slot and a closure such as a zipper. The closure is used to close the slot to retain and conceal the container within the shell, and to open the slot to remove the container from the shell for cleaning. In addition, the seat portion includes a cushion with a cavity in its bottom surface that removably receives the container. The cushion and container can be inserted into the shell. The device is portable so that it can be transported to events and activities.

Preferably, the container is a flexible bladder and the dispensing assembly includes a liquid line, a coupling that connects the liquid line to the container, a valve in the liquid line, and a nozzle coupled to the liquid line. The valve is openable to dispense the beverage through the nozzle. The liquid line is flexible and can be moved between a stored position (with the dispensing assembly retracted into and concealed within the seat portion) and a dispensing position (with the nozzle extending from the seat portion). And the coupling is preferably removable so that the dispensing assembly can be detached from the container for cleaning and refilling.

With the container in the shell, the liquid line in the stored position, and the slot closed by the closure, then the container and dispensing assembly are retained and concealed within the shell. With the slot at least partially opened by the closure, then the liquid line is movable to the extended position for dispensing the beverage. And with the slot opened by the closure, the container is removable from the shell for cleaning.

In a first alternative embodiment of the seat portion, the cushion has a sidewall with a notched opening through to the cavity. In a second alternative embodiment of the seat portion, the cushion has upper and lower panels with the cavity between them, and a sidewall opening through to the cavity and generally having the same height and width. In a third alternative embodiment of the seat portion, the seat portion has a rigid frame with a cavity for the container and an inclined inner base surface upon which the container rests. Preferably, the seat portion further includes a cushion atop the rigid frame and an elastic element that retracts the dispensing assembly into the seat portion. And in a fourth alternative embodiment of the seat portion, the cushion has upper, inner, and lower panels assembled together, with the cavity in the inner panel and a sidewall slit opening through to the cavity and having generally the same width as the cavity. It will be understood that other alternative seat portions may be used in the device.

In a second example embodiment of the present invention, the seat portion includes a backrest and a support frame. In a third example embodiment, the seat portion includes a backrest and a seat base board that are thermo form molded. And in a fourth example embodiment, the seat portion includes a backrest, a seat base board, and a support frame that are blow molded, roto molded, and/or twin sheet molded. These embodiments may incorporate any of the alternative seat portions described above or others not specifically described herein.

In addition, another aspect of the present invention is a method of making a portable sitting and liquid-dispensing device. The method includes the steps of providing a container for a liquid, a dispensing assembly, and a seat portion including a cushion and a shell; forming a cavity in the cushion that is configured to receive the container; inserting the container into the cavity in the cushion; and inserting the cushion, the container, and the dispensing assembly into the shell.

Accordingly, the present invention provides a sitting and liquid-dispensing device with a container that can be filled with a beverage and placed in the seat portion for convenient, safe, and discrete transportation to an event or activity. And then after use, the container can be easily removed from the seat portion for cleaning and refilling.

The specific techniques and structures employed by the invention to improve over the drawbacks of the prior devices and accomplish the advantages described herein will become apparent from the following detailed description of the example embodiments of the invention and the appended drawings and claims.

BRIEF DESCRIPTION OF THE DRAWINGS

FIG. 4 is a cross-sectional view of the device of FIG. 1, showing the seat portion being compressed to dispense the beverage in the container.

FIG. 5 is a bottom perspective view of a seat portion cushion according to a first alternative embodiment, showing a cavity and a sidewall opening.

FIG. 6 is a plan view of a seat portion cushion according to a second alternative embodiment, showing an interior cavity and a sidewall opening.

FIG. 7 is a cross-section view of the seat portion cushion of FIG. 6 taken at line 7—7 thereof.

FIG. 8 is a front elevation view of the seat portion cushion of FIG. 6.

DESCRIPTION OF EXAMPLE EMBODIMENTS

Figure 1:
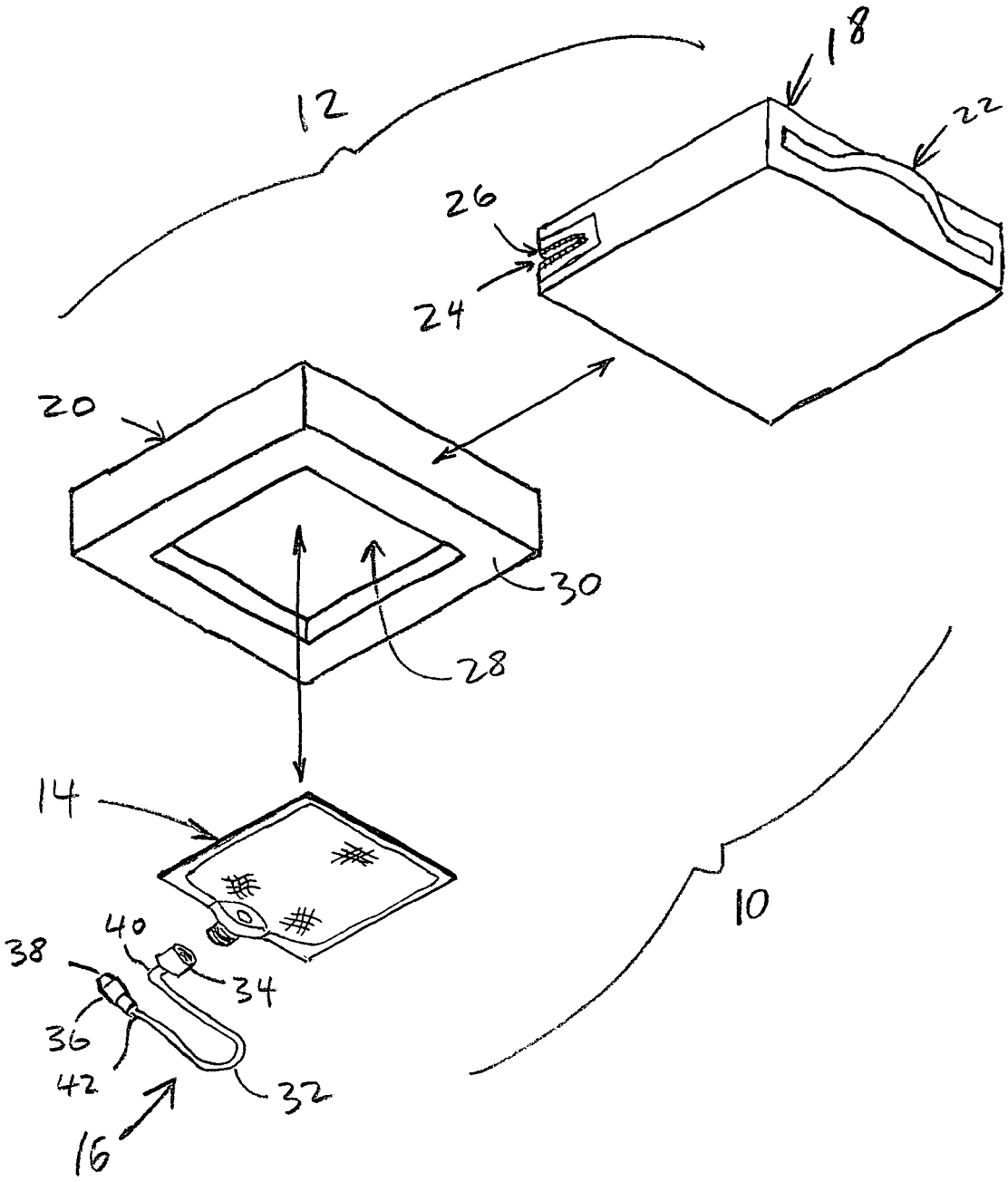
FIG. 1 is a bottom perspective exploded view of a portable sitting and liquid-dispensing device according to a first exemplary embodiment of the present invention, showing a seat portion having a cushion and a shell, a container, and a dispensing assembly.

Generally described, the invention comprises a sitting device that is also used to store and dispense liquids. The sitting device includes a seat portion, a liquid container removably received within the seat portion, and a dispensing assembly coupled to the container. The seat portion may be provided by, for example, a seat cushion, a stadium chair, a beach, patio, or lawn chair, etc., with or without a seat back. Preferably, the seat portion is portable for conveniently and discretely transporting the liquid to an event such as a sports game or concert, or to another activity such as fishing, hunting, or boating. The container holds beverages such as soda, water, alcohol, and/or other liquids. The seat portion fully contains, and thus conceals, both the container (or more than one of them) and the dispensing assembly (or more than one of them) so that the container can be safely and discretely stored during transport, the dispensing assembly can be easily accessed for dispensing the beverage, and the container and dispensing assembly can be removed afterward for cleaning. The sitting device is preferably made from commercially available components that may be selected and assembled by a person of ordinary skill in the art.

Referring now to the drawing figures, FIGS. 1–4 illustrate a portable sitting and liquid-dispensing device 10 according to a first exemplary embodiment of the present invention. The device 10 includes a seat portion 12 for sitting upon, a container 14 for a liquid such as a beverage, and a dispensing assembly 16 for dispensing the beverage from the container. The container 14 and dispensing assembly 16 are removably received within the seat portion 12. The seat portion 12 is preferably sized to be large enough to provide sifting comfort but small enough to provide portability. In a typical commercial embodiment, the seat portion 12 is about 13 inches by about 13 inches by about 2.5 inches.

The seat portion 12 preferably includes a shell 18 and a cushion 20 that is received within and covered by the shell. The shell 18 is preferably made of a plastic or other weatherable material and/or is treated to provide moisture/weather resistance. In a typical commercial embodiment, the shell 18 is made of a high quality nylon/acrylic blended fabric that resists moisture and staining. The shell 18 preferably has a handle strap 22, or another carrying structure known in the art, for portability of the device 10.

The cushion 20, the container 14, and the dispensing assembly 16 are preferably removable from the shell 18 so that they can be cleaned. In a typical commercial embodiment, the shell 18 has a slot 24 and a closure 26 that is operable to open and close the slot, with the slot configured so that the cushion, the container, and the dispensing assembly can fit through it. For example, the closure may be provided by a zipper (as shown), overlapping flaps with hook-and-loop (e.g., VELCRO) fasteners, snaps, buttons, or another closure known in the art. Although the zipper is shown clearly in the figures, the shell may be provided with a flap for covering and hiding the zipper and/or the zipper may have a color that blends with the color of the shell to reduce how noticeable the zipper is.

In an alternative embodiment, the container is fixed to or integrally formed with the cushion so that cushion and container are together removed from shell for cleaning both and refilling the container. In another alternative embodiment, the container, cushion, and shell may be fixed together or integrally formed together so that the cushion and container are not removable from the shell but so that the container can be refilled without being completely removed from the shell. For example, the device may be configured with a refilling opening of the container accessible through the slot, or the slot can extend far enough around the periphery of the shell that it can be opened to expose the container for refilling without removing it from the shell.

The cushion 20 is preferably made of a compressible material such as a foam, a gel, or another material selected for providing at least some user comfort. In a typical commercial embodiment, the material is an exterior grade foam that does not retain moisture. The material may also be selected with insulating properties for keeping the beverage in the container 14 at a desired temperature and to protect the user from extreme liquid temperatures.

In addition, the cushion 20 defines a cavity 28 that is configured with a peripheral dimension and a depth to receive the container 14 therein and so that the cushion, with the container received in the cavity, can be inserted and concealed in the shell 18. For example, the container 14 and the cavity 28 may both have rectangular shapes. Alternatively, the container 14 and the cavity 28 may have other conforming shapes, or they may have different shapes that still permit the container 14 to fit into the cavity. In addition, the depicted embodiment has the cavity 28 defined by a bottom surface 30 of the cushion 20. It will be understood that alternatively the cavity may be formed in other surfaces of the cushion.

The container 14 is made of a plastic, rubber, or other material selected for strength and durability. In particular, the material is selected so that the container 14 can withstand the weight of an adult sitting on it, and so that the container does not leak when being sat upon or when being carried at any angle. For example, the container 14 may be provided by a flexible bladder made of a clear plastic that compresses under the user's weight. When the flexible bladder container 14 is full, the beverage in it can be dispensed under the force of gravity, without the user sitting on or otherwise compressing the seat portion 12. And when the flexible bladder container 14 is nearing empty, the beverage remaining in it can be dispensed under the compressive force from the user sitting on or otherwise compressing the seat portion 12, or by lifting the handle on the back side of the device 10 to drain the beverage by gravity. In a typical commercial embodiment, the container 14 is sized to hold a volume of about 3 cups of the beverage, though other-sized containers can be used. In addition, when the container 14 is at least partially filled with a beverage, the seat portion 12 is more comfortable to the user (in the manner that a waterbed is comfortable). When the beverage is heated or cooled, it may provide further temperature-related comfort to the user.

The dispensing assembly 16 includes a liquid line 32, a coupling 34, an open/close valve 36, and a nozzle 38. The liquid line 32 is preferably provided by a hose, tube, or other flexible liquid carrying line, and has a first end 40 and a second end 42. The coupling 34 connects the first end 40 of the liquid line 32 to the container 14. Preferably, the coupling 34 is provided by a removable coupling, for example, with inner threads that mate with outer threads on a neck of the container 14, the neck defining an access opening for filling and emptying the container. In this way, the dispensing assembly 16 can be detached from the container 14 for cleaning both and refilling the container.

The nozzle 38 is coupled to the second end 42 of the liquid line 32, and the valve 36 is operable to open and close the liquid line 32. When the valve 36 is open, the beverage can be dispensed through the nozzle 38. And when the valve 36 is closed, it retains the beverage in the container 14. Preferably, the valve 36 and the nozzle 38 are provided together in a single component, for example, as the twist-type valve shown.

Figure 2:
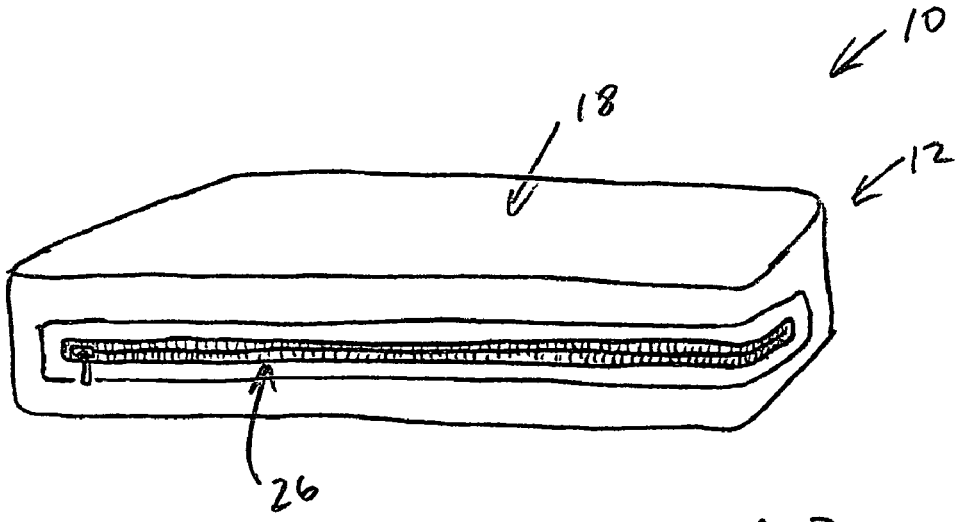
FIG. 2 is a top perspective view of the device of FIG. 1 with the dispensing assembly in the stored position within the shell.
Figure 3:
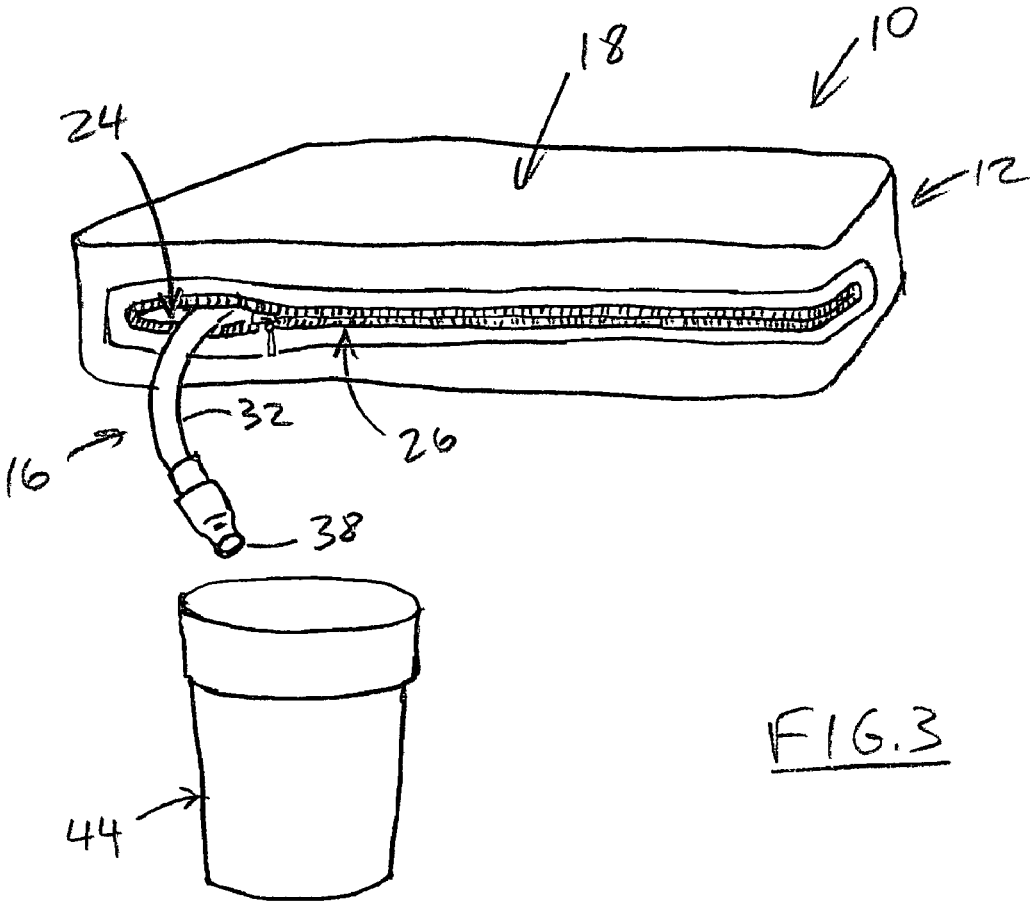
FIG. 3 is a top perspective view of the device of FIG. 1 with the dispensing assembly in the dispensing position extending out of the shell.
Figure 10:
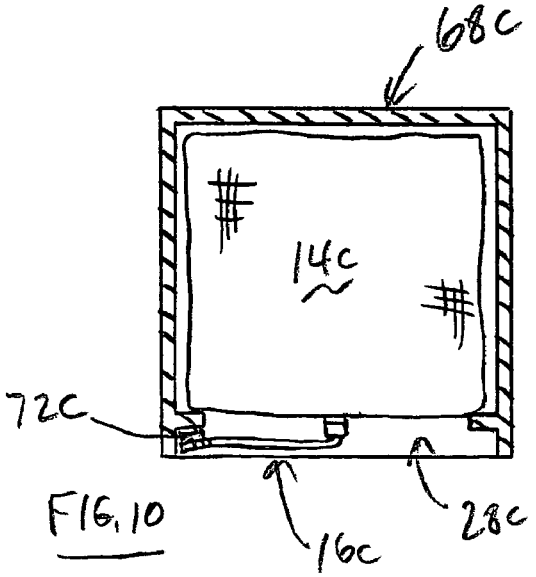
FIG. 10 is a cross-section view of the seat portion of FIG. 9 taken at line 10—10 thereof.
Figure 11:
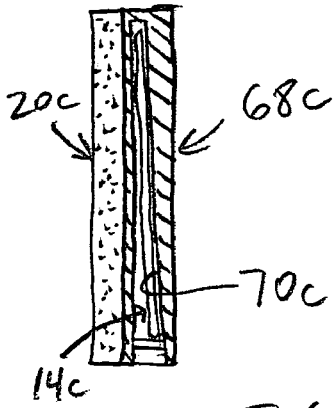
FIG. 11 is a cross-section view of the seat portion of FIG. 9 taken at line 11—11 thereof.
Figure 9:
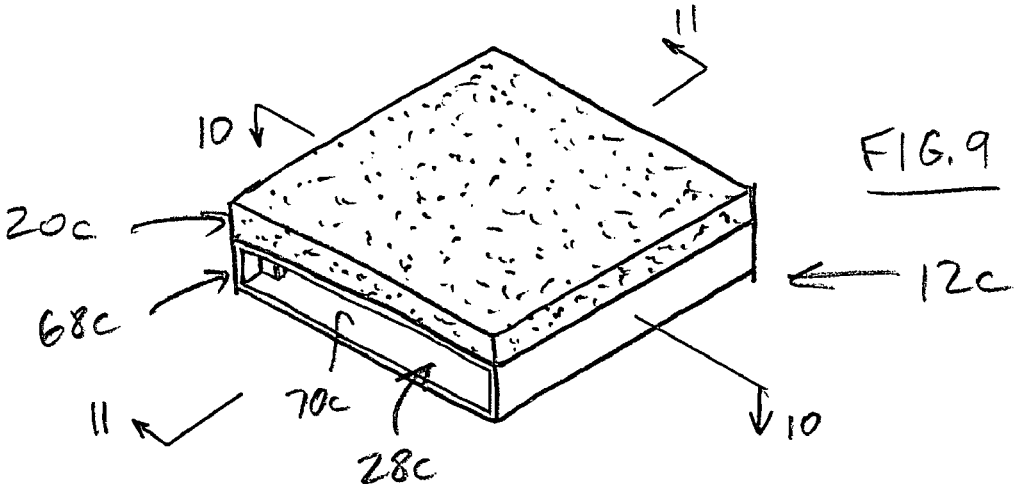
FIG. 9 is a top perspective view of a seat portion according to a third alternative embodiment, showing a rigid frame with a cavity for the container and a cushion.
Figure 12:
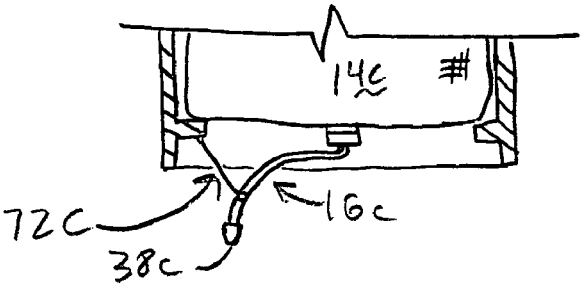
FIG. 12 is a partial view of the seat portion of FIG. 10, showing an elastic element stretched with the dispensing assembly in the dispensing position.

The liquid line 32 is flexible and movable between a stored position within the shell 18 (see FIG. 2) and a dispensing position with the nozzle 38 extending out of the shell (see FIG. 3). With the container 14 in the shell 18, the liquid line 32 in the stored position, and the slot 24 closed by the closure 26, then the container and dispensing assembly 16 are retained and concealed within the shell, as shown in FIG. 2. With the slot 24 at least partially opened by the closure 26, then the liquid line 32 is movable to the extended position for dispensing the beverage, for example, into a cup 44, as shown in FIG. 3. To dispense the beverage, the user sits on the seat portion 12 or otherwise compresses it, as indicated by the force arrow shown in FIG. 4, which compresses the flexible bladder container 14 and forces the beverage through the liquid line 32, opened valve 36, and nozzle 38. And with the slot 24 opened by the closure 26, the container 14 is removable from the shell 18 for cleaning, as shown in FIG. 1.

It will be understood that the invention includes alternative seat portions that can be used in the sitting and liquid-dispensing device 10 of the first example embodiment and/or in other embodiments of the invention. Thus, the cushions of the below-described first and second alternative embodiments, and the seat portion of the below-described third alternative embodiment, can be used with the shell, container, and dispensing assembly of the first example embodiment and/or of other embodiments of the invention.

Referring to FIG. 5, there is shown a first alternative embodiment of a cushion 20*a* having a bottom surface 30*a* defining a cavity 28*a*, similar to the cushion 20 of the first example embodiment. In this embodiment, however, the cushion 20*a* has a notched opening 60*a* defined by and extending through a sidewall 62*a* of the cushion, with the opening in communication with the cavity. In this embodiment, the dispensing assembly can extend through the opening for ease of use.

Referring to FIGS. 6–8, there is shown a second alternative embodiment of a cushion 20*b* that is similar to the cushion 20 of the first example embodiment. In this embodiment, however, the cushion 20*b* includes upper and lower panels 64*b* and 66*b* that cooperatively define the cavity 28*b* between them. Preferably, the cushion 20*b* is symmetrical, with the container in the middle of the panels 64*b* and 66*b* to allow cushioning on both sides (i.e., so that the device is reversible and can be used on one side or flipped for use on the other). In addition, an opening 60*b* extends through a sidewall 62*b* of the cushion so that the container can be accessed and removed more easily, with the opening and the cavity having generally the same horizontal and vertical dimensions, as shown.

Referring to FIGS. 9–12, there is shown a third alternative embodiment of a seat portion 12*c* having additional features. The seat portion includes a rigid frame 68*c* defining a cavity 28*c* configured to removably receive the container 14*c*, and a cushion 20*c* positioned atop the frame. The frame 68*c* preferably has an inclined inner base surface 70*c* (see FIG. 11) upon which the container 14*c* rests for dispensing the beverage by gravity, and the container may be made of a rigid material such as hard plastic. In addition, the seat portion 12*c* preferably includes an elastic element 72*c* (e.g., a BUNGEE cord, a spring, or another resilient member) coupled to the dispensing assembly 16*c* for biasing the nozzle 38*c* to a retracted position (see FIG. 10) and permitting the nozzle to be extended to the dispensing position (see FIG. 12). The rigid frame 68*c* structurally supports the weight of the user so that the container 14*c* does not bear any load from the user, and the padded top cushion 20*c* provides for user comfort.

Figure 13:
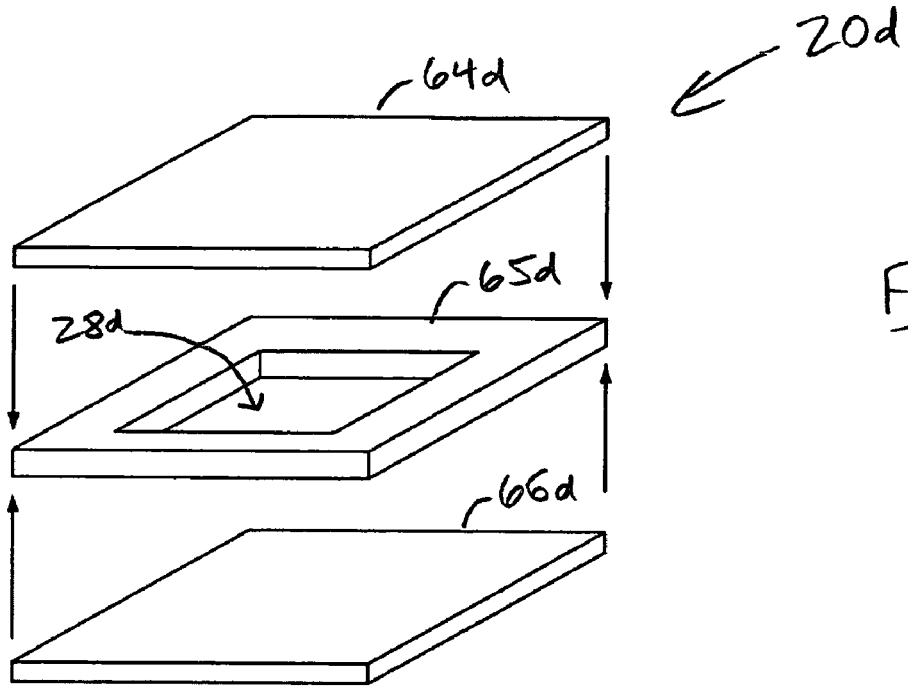
FIG. 13 is a top perspective exploded view of a seat portion cushion according to a fourth alternative embodiment, showing the cushion made of three panels.
Figure 14:
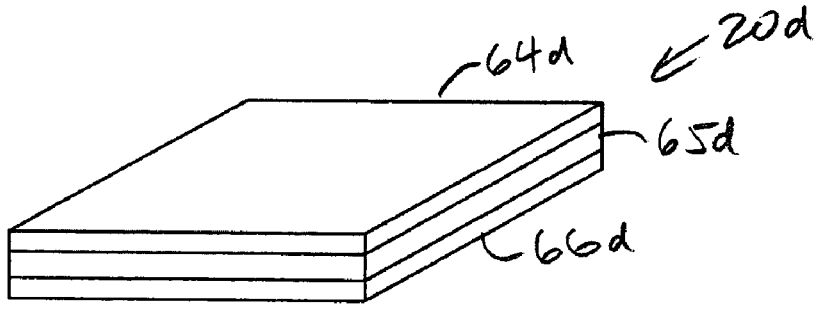
FIG. 14 is a top perspective view of the cushion of FIG. 13, showing the cushion assembled for use.
Figure 15:
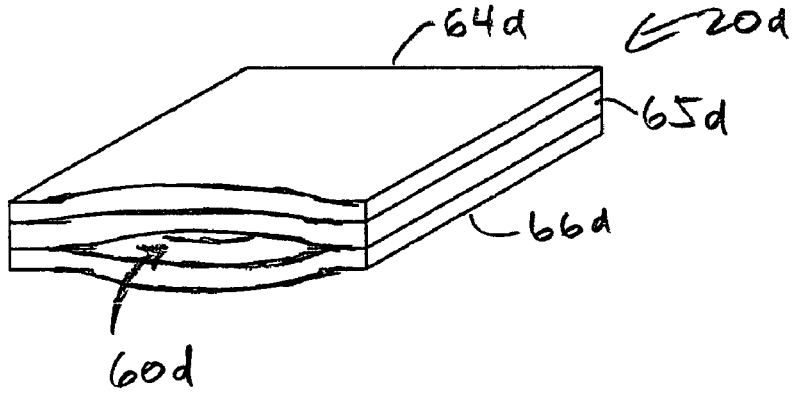
FIG. 15 is a top perspective view of the cushion of FIG. 13, showing slit opened for accessing the cavity.

Referring to FIGS. 13–15, there is shown a fourth alternative embodiment of a cushion 20*d* that is similar to the cushion 20*b* of the second alternative embodiment. In this embodiment, however, the cushion 20*d* is made of an upper panel 64*d*, an inner panel 65*d*, and a lower panel 66*d* assembled together by, for example, an epoxy. The cavity 28*d* is defined, at least partially, by the middle panel 65*d*. A sidewall opening 60*d* in communication with the cavity 28*d*, for example, a slit, is formed in the cushion 20*d* for inserting and removing the container and for accessing the dispensing assembly for use. The slit opening 60*d* preferably has generally the same horizontal dimension as the cavity 28*d*, as shown. The slit opening 60*d* can be formed between two of the panels, for example, the inner and lower panels 65*d* and 66*d*, or through only one of the panels. Preferably, the panels 64*d*, 65*d*, 66*d* are made of an outdoor grade open cell foam rated very firm or medium firm. And more preferably, the inner panel 65*d* is less firm (e.g., medium firm foam) than the outer panels 64*d*, 66*d* (e.g., very firm foam).

Figures 16, 17:
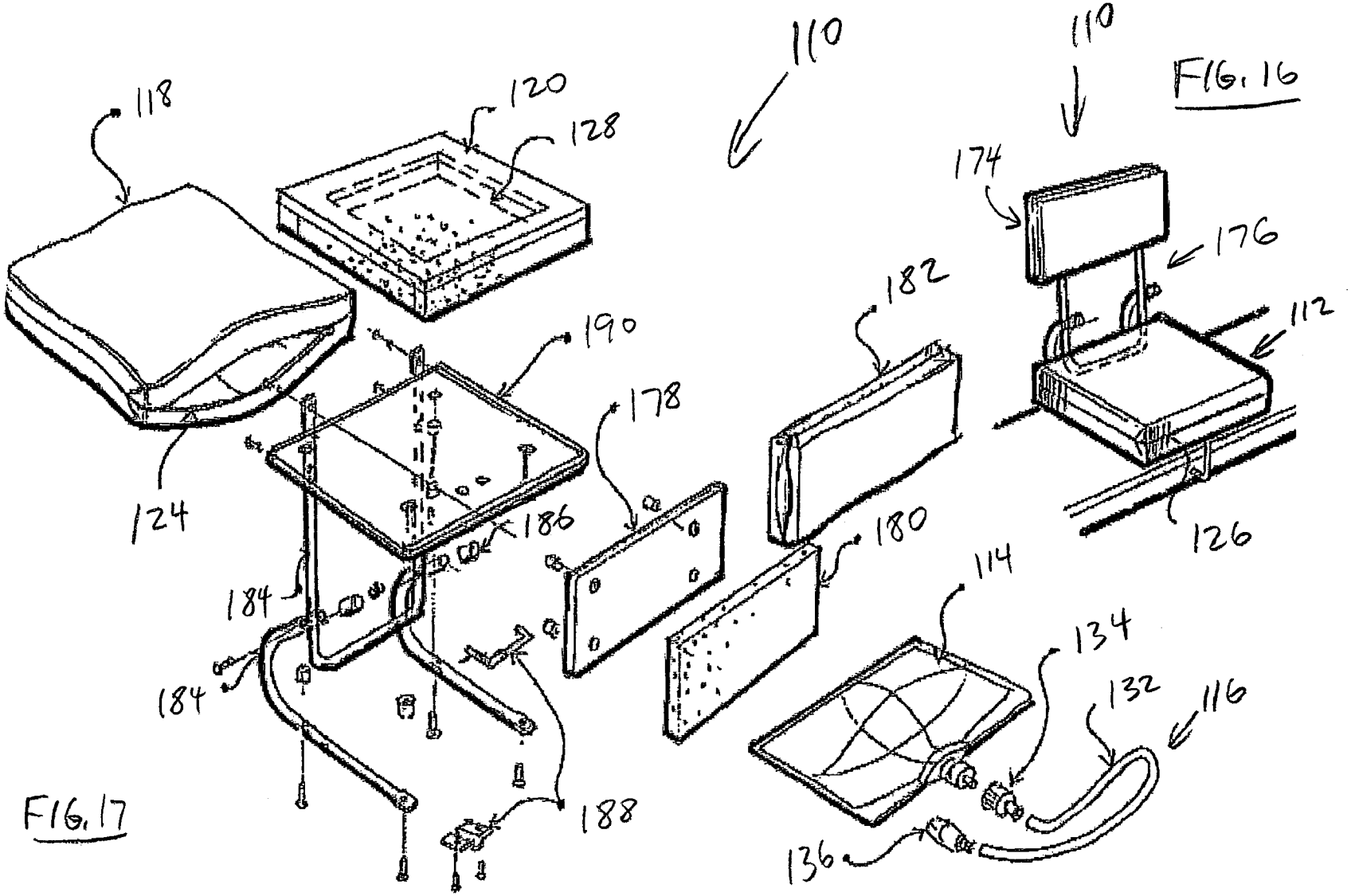
FIG. 16 is a top perspective view of a portable sitting and liquid-dispensing device according to a second exemplary embodiment of the present invention, showing the seat portion including a backrest.
FIG. 17 is an exploded view of the device of FIG. 16.

Referring to FIGS. 16 and 17, there is shown a sitting and liquid-dispensing device 110 according to a second example embodiment of the invention. This device 110 is similar to the device 10 of the first example embodiment in that includes a seat portion 112, a container 114 (e.g., bladder), and a dispensing assembly 116. The seat portion 112 includes a shell 118 (e.g., fabric) having a slot 124 and a closure 126 (e.g., concealed zipper), and a cushion 120 having a cavity 128 for the container 114. And the dispensing assembly 116 has a liquid line 132 (e.g., an 18 inch length of ⅜ inch OD clear PVC hose), a coupling 134, and a valve 136 (e.g., a twist valve with a nozzle).

However, this device 110 has a few differences. The device 110 has a seat portion 112 that includes a backrest 174 and a support frame 176. The backrest 174 includes a seat back board 178 (e.g., ½ inch foam board with 4 threaded inserts), a seat back cushion 180 (e.g., foam), and a cover shell 182 (e.g., fabric). The support frame 176 may be constructed of ⅝ inch OD steel tubing 184 with tube caps 186 assembled together with screws. The device 110 also includes a seat hook assembly 188 and a seat base board 190 (e.g., ½ inch foam board with 6 threaded inserts).

Figure 18:
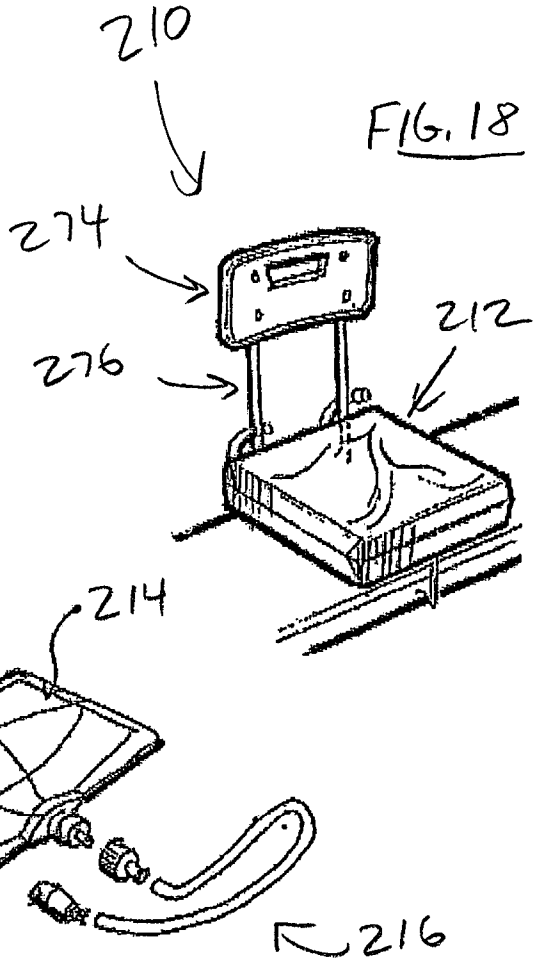
FIG. 18 is a top perspective view of a portable sitting and liquid-dispensing device according to a third exemplary embodiment of the present invention, showing the seat portion including a molded backrest.
Figure 19:
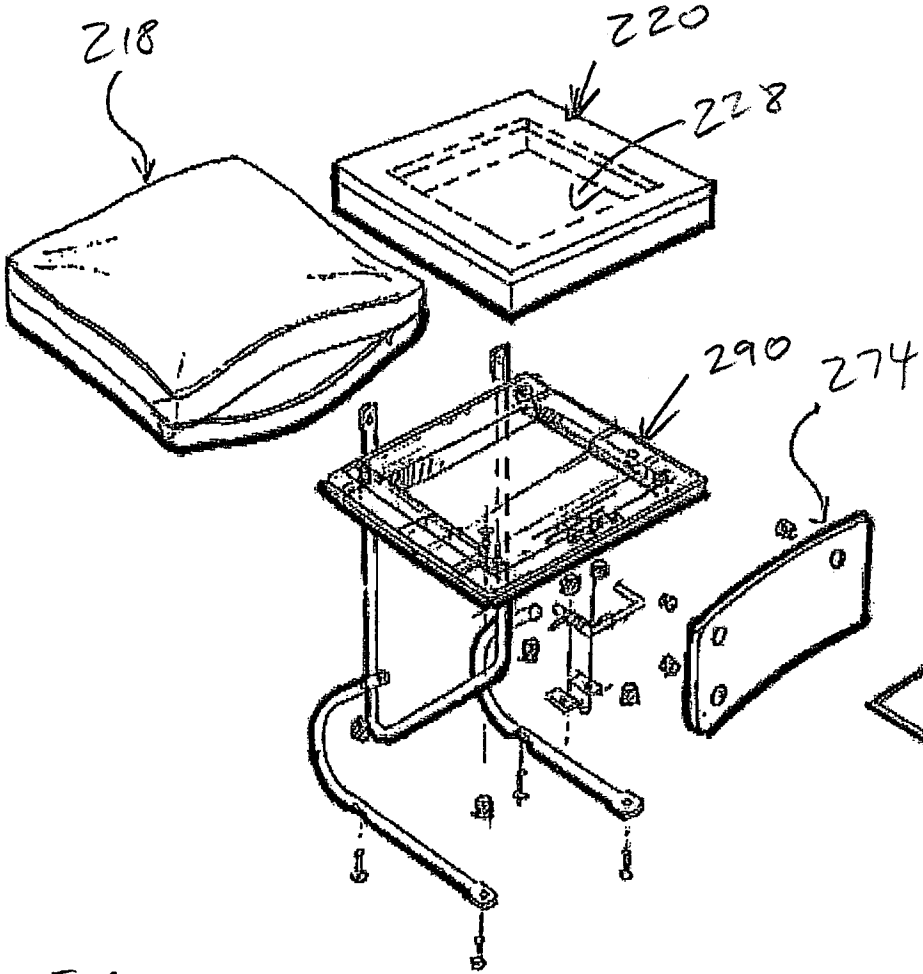
FIG. 19 is an exploded view of the device of FIG. 18.

Referring to FIGS. 18 and 19, there is shown a sitting and liquid-dispensing device 210 according to a third example embodiment of the invention. This device 210 is similar to the device 110 of the second example embodiment in that includes a seat portion 212, a container 214, and a dispensing assembly 216. The seat portion 212 includes a shell 218 and a cushion 220 having a cavity 228 for the container 214. In this embodiment, however, the device 210 has a backrest 274 and a seat base board 290 that are thermo form molded.

Figure 20:
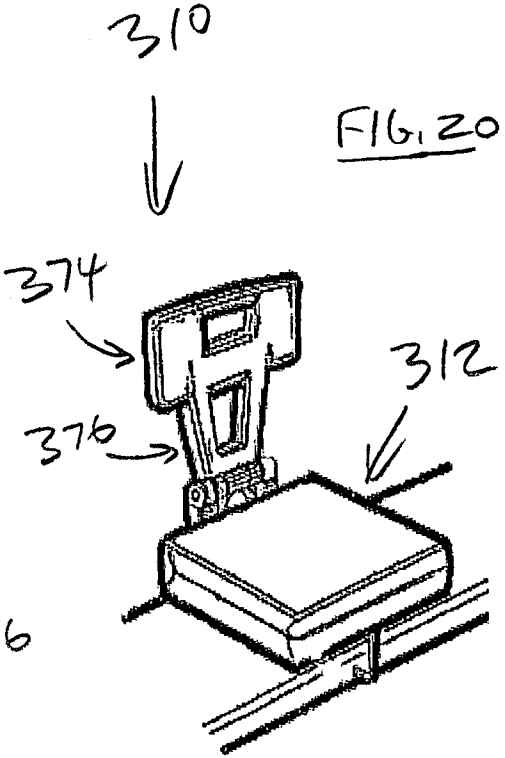
FIG. 20 is a top perspective view of a portable sitting and liquid-dispensing device according to a fourth exemplary embodiment of the present invention, showing the seat portion including another molded backrest.
Figure 21:
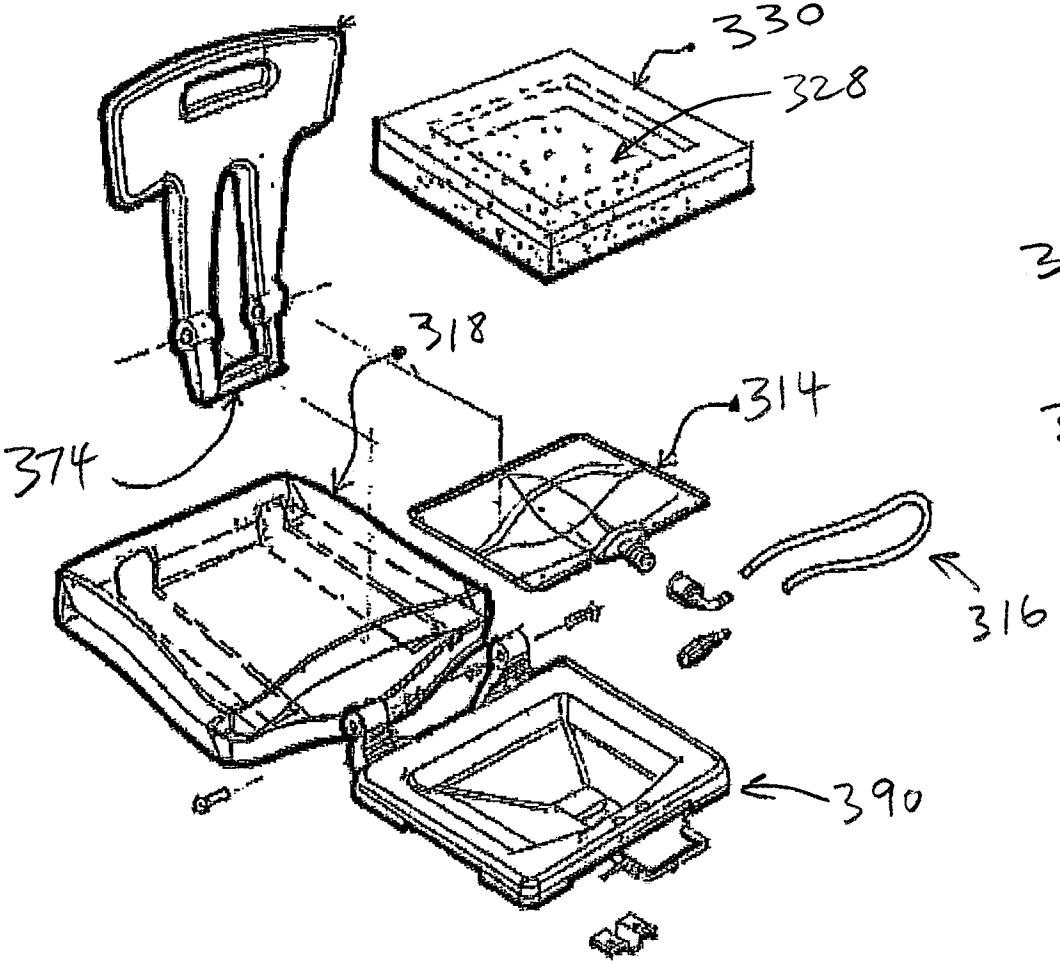
FIG. 21 is an exploded view of the device of FIG. 20.

Referring to FIGS. 20 and 21, there is shown a sitting and liquid-dispensing device 310 according to a fourth example embodiment of the invention. This device 310 is similar to the device 210 of the third example embodiment in that includes a seat portion 312, a container 314, and a dispensing assembly 316. The seat portion 312 includes a shell 318 and a cushion 320 having a cavity 328 for the container 314. In this embodiment, however, the device 310 has a backrest 374, a seat base board 390 and a support frame 376 that are blow molded, roto molded, and/or twin sheet molded.

In another alternative embodiment, the device has a seat portion with a hollow plastic rigid frame without a padded top cushion or cover shell. In still another alternative embodiment, the sitting device is adapted for inside home or office use, with a larger and less portable seat portion. In yet another alternative embodiment, the sitting device has a flexible bladder container that is elongated and folded over to pad the user from the cap, liquid line, and valve of the dispensing assembly. In a further alternative embodiment, the device is in the form of a women's purse with a built-in beverage container and dispensing assembly. And in another alternative embodiment, the sitting device has a seat portion including a backrest, with the container and dispensing assembly arranged in the backrest.

In another aspect of the invention, there is provided a method of making a portable sitting and liquid-dispensing device. The method can be used to manufacture devices according to any of the example embodiments described herein as well as other similar devices not specifically described and shown herein but nevertheless contemplated by and included in the present invention. The method can be carried out using commercially available components that may be selected and assembled by a person of ordinary skill in the art. The method includes the steps of providing a container for a liquid, a dispensing assembly, and a seat portion including a cushion and a shell; forming a cavity in the cushion that is configured to receive the container; inserting the container into the cavity in the cushion; and inserting the cushion, the container, and the dispensing assembly into the shell.

Accordingly, the present invention provides a number of advantages not found in previous devices. The container holds beverages or other liquids and is removably disposed in the cavity of the seat portion so that it can be conveniently, safely, and discretely transported and used, and then removed afterward for cleaning. And the open/close valve and liquid line are positionable in the cavity for concealment during transport and use, and extendable to the exterior of the device for dispensing the beverage from the container.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the claimed invention. For example, as used in the specification including the appended claims, the singular forms "a," "an," and "the" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as defined by the following claims.

What is claimed is:

1. A combination sitting and liquid-dispensing device, comprising:

a) a seat portion for sifting upon;

b) a container for liquid, the container fully contained within the seat portion; and c) a dispensing assembly coupled to the container for dispensing the liquid therefrom, the dispensing assembly fully contained within the seat portion, the dispensing assembly including a liquid line with a first end and a second end, the first end of the liquid line connected to the container and the second end of the liquid line adapted to dispense the liquid therethrough wherein the liquid line is flexible and movable between a stored position with the dispensing assembly retracted into and concealed within the seat portion and a dispensing position with the second end of the liquid line extending from the seat portion.

2. The device of claim 1, wherein the seat portion includes a shell and the container is removably received within the shell.

3. The device of claim 2, wherein the shell includes a slot with a closure operable to close the slot to retain and conceal the container within the shell and operable to open the slot to remove the container from the shell for cleaning.

4. The device of claim 3, wherein the seat portion includes a cushion defining a cavity configured to removably receive the container, the cushion received within the shell.

5. The device of claim 1, wherein the container comprises a flexible bladder that compresses under a user's weight when sat upon to dispense the liquid by the compression.

6. The device of claim 1, wherein the dispensing assembly further includes a coupling that connects the first end of the liquid line to the container, a valve in the liquid line, and a nozzle coupled to the second end of the liquid line, wherein the valve is operable to dispense the liquid through the nozzle.

7. The device of claim 1, wherein the coupling comprises a removable coupling so that the dispensing assembly can be detached from the container for cleaning and refilling.

8. The device of claim 1, wherein the sitting device is portable.

9. The device of claim 1, wherein the seat portion includes a rigid frame defining a cavity configured to removably receive the container.

10. The device of claim 9, wherein the rigid frame has an inclined inner base surface upon which the container rests for dispensing the liquid by gravity.

11. The device of claim 9, wherein the seat portion further includes a cushion positioned atop the rigid frame.

12. A combination sitting and liquid-dispensing device, comprising:

a) a seat portion for sitting upon;

b) a container for liquid, the container fully contained within the seat portion; and c) a dispensing assembly coupled to the container for dispensing the liquid therefrom, the dispensing assembly fully contained within the seat portion, wherein the dispensing assembly includes a nozzle through which the liquid is dispensed and the seat portion includes an elastic element coupled to the dispensing assembly for biasing the nozzle to a retracted position.

13. A portable sitting and liquid-dispensing device, comprising:

a) a seat portion for sitting upon, the seat portion including a cushion and a shell, the cushion defining a cavity and the shell receiving the cushion therein, the shell including a slot and a closure that is operable to open and close the slot;

b) a container for liquid, the container removably received in the cushion cavity and concealable within the shell;

c) a dispensing assembly including a liquid line coupled to the container and a nozzle for dispensing the liquid from the container, the liquid line flexible and movable between a stored position within the shell and a dispensing position with the nozzle extending out of the shell;

d) wherein with the container in the shell, the liquid line in the stored position, and the slot closed by the closure, then the container and dispensing assembly are fully retained and concealed within the shell;

e) wherein with the slot at least partially opened by the closure, then the liquid line is movable to the extended position for dispensing the liquid; and f) wherein with the slot opened by the closure, the container is removable from the shell for cleaning.

14. The device of claim 13, wherein the container comprises a flexible bladder that compresses under a user's weight when sat upon to dispense the liquid by the compression.

15. The device of claim 13, wherein the dispensing assembly includes a removable coupling connecting the liquid line to the container so that the dispensing assembly can be detached from the container for cleaning and refilling.

16. The device of claim 13, wherein the cavity is defined by a bottom surface of the cushion.

17. The device of claim 13, wherein the cushion includes upper and lower panels cooperatively defining the cavity therebetween.

18. The device of claim 13, wherein the cushion includes a sidewall defining an opening in communication with the cavity.

19. The device of claim 13, wherein the cushion includes upper, inner, and lower panels assembled together, with the cavity at least partially defined by the inner panel.

20. The device of claim 19, wherein the cushion further includes a sidewall defining a slit in communication with the cavity.

21. The device of claim 13, wherein the seat portion further comprises a backrest.

22. A method of making a portable sifting and liquid-dispensing device, comprising:

a) providing a container for a liquid, a dispensing assembly, and a seat portion including a cushion and a shell, the dispensing assembly including a liquid line with a first end and a second end, the first end of the liquid line connected to the container and the second end of the liquid line adapted to dispense the liquid therethrough;

b) forming a cavity in the cushion that is configured to receive the container;

c) inserting the container into the cavity in the cushion; and d) inserting the cushion, the container, and the dispensing assembly into the shell with these elements fully contained within the shell wherein the liquid line is flexible and movable between a stored position with the dispensing assembly retracted into and concealed within the shell and a dispensing position with the second end of the liquid line extending from the shell.

* * * * *